United States Patent [19]

Cargile, Jr.

[11] 4,272,363

[45] Jun. 9, 1981

[54] COAL WASHING APPARATUS

[76] Inventor: Neil H. Cargile, Jr., Box 1067, Nashville, Tenn. 37202

[21] Appl. No.: 56,685

[22] Filed: Jul. 11, 1979

[51] Int. Cl.[3] ..... B03B 5/28

[52] U.S. Cl. ..... 209/10; 209/17; 209/464; 209/501

[58] Field of Search ..... 209/172.5, 44, 10, 501, 209/500, 17, 155, 463, 464

[56] References Cited

U.S. PATENT DOCUMENTS

| | | | |
|---|---|---|---|
| 2,368,416 | 1/1945 | Holt | 209/172.5 |
| 3,154,805 | 11/1964 | Egee et al. | 209/17 X |
| 3,645,397 | 2/1972 | Weiss | 209/464 |
| 3,695,427 | 10/1972 | Friesz | 209/44 |
| 3,739,911 | 6/1973 | Patch | 209/155 X |

*Primary Examiner*—William A. Cuchlinski, Jr.
*Attorney, Agent, or Firm*—Harrington A. Lackey

[57] ABSTRACT

An apparatus for separating relatively heavy particles, such as rock, from relatively light particles, such as coal, in a liquid, such as water, of lesser specific gravity than either the heavier or the lighter particles, comprising an upwardly inclined trough and auger driven to move particles upward in the trough, means for feeding a mixture of the heavier and lighter particles into the trough, a liquid dispensing means above the feed means for discharging liquid down the trough to create turbulent flow, and a weir forming a pool in the lower end of the trough.

The invention further comprises an auger having an upper end which is spaced below the upper end of the trough to provide a space for the accumulation of heavy particles at the upper end of the trough to facilitate dewatering of the heavy particles before discharge from the upper end of the trough.

The invention is further characterized by a recirculation system in which liquid containing lighter particle fines are separated from the major portion of the lighter particles and recirculated in varying densities through the liquid dispensing means.

8 Claims, 3 Drawing Figures

COAL WASHING APPARATUS

BACKGROUND OF THE INVENTION

This invention relates to an apparatus for separating relatively heavy particles from relatively light particles, and more particularly to a coal washing apparatus.

Heretofore, inclined troughs supporting augers have been employed in combination with liquids of various types for separating heavier particles from lighter particles by gravitation of the heavier particles in the liquid in a relatively still pool in the lower portion of the auger, such as disclosed in the U.S. Pat. No. 2,368,416, Holt.

An inclined trough and auger have been used for the separation of relatively heavy and light particles in a liquid medium by turbulent flow in an auger having an open lower end, as taught in the U.S. Pat. No. 3,739,911, Patch, issued June 19, 1973, particularly adapted for the separation of coal from heavier debris, such as rock.

SUMMARY OF THE INVENTION

It is therefore an object of this invention to provide an apparatus for separating relatively heavy particles from lighter particles in a liquid medium whose specific gravity is less than both the lighter and the heavier particles, and incorporating an inclined trough and auger.

One feature of the invention is the provision of a definite space between the upper end of the auger and the open upper end of the trough to permit the accumulation of the heavier particles fed to the upper portion of the trough by the auger. The accumulated heavy particles function as a dam to block the upward movement of the liquid or water fed by the flights of the auger, and thereby permit more of the liquid to be recycled. The excess accumulated heavier particles will spill over the upper end of the trough.

A weir at the lower end of the auger forms a relatively still pool of liquid in order to provide a more efficient separation of the lighter particles, such as coal, from the heavier particles, such as rock. However, the turbulent flow of the liquid along the auger above the pool provides sufficient agitation to maintain the lighter particles, such as the coal, in the upper strata of the pool, so that the accumulated coal particles force each other over the top of the weir to provide a more effective separation process and yield a cleaner coal particle.

A further feature of this invention is to provide recirculation system for the water or liquid incorporated in the separation process whereby the water flowing over the weir along with the coal is separated from the major portion of the coal, yet retains the coal fines to gravitate into a sump or reservoir as a slurry. The recirculation system permits optional retrieval of the slurry at different levels in order to provide a separating liquid of selectively different densities for recirculation to the trough for the separation of the lighter particles from the heavier particles by flotation.

DESCRIPTION OF THE PREFERRED EMBODIMENTS

Figures 1, 2, 3:
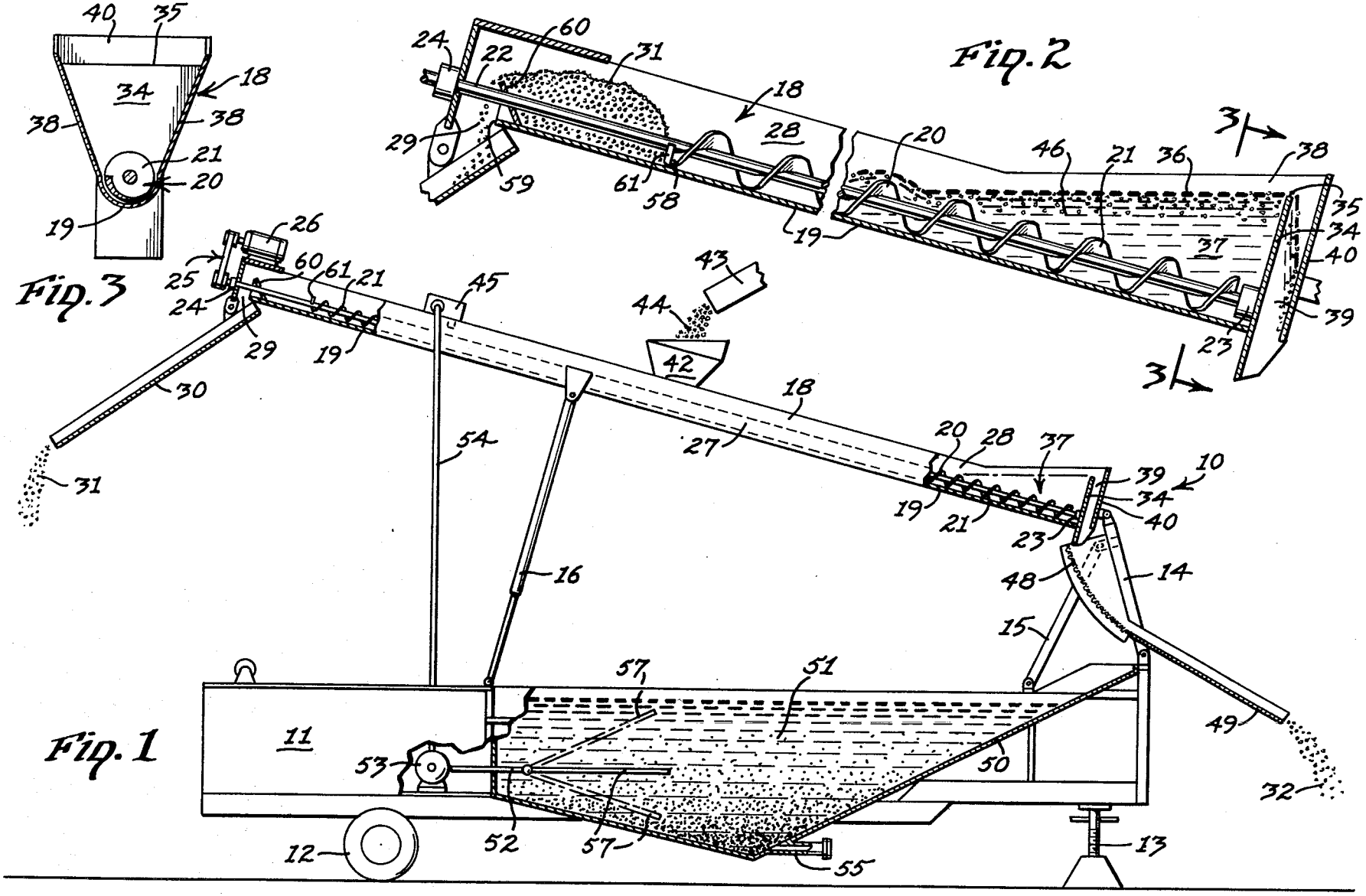
FIG. 1 is a side elevation of the coal washing apparatus made in accordance with this invention, with portions of the side walls of the trough and the reservoir broken away.
FIG. 2 is an enlarged, fragmentary section of the upper and lower ends of the trough and the auger.
FIG. 3 is a section taken along the lines 3—3 of FIG. 2.

Referring now to the drawings in more detail, FIG. 1 discloses a coal washing apparatus 10 including a mobile frame 11 supported at one end on wheels 12 and at its opposite end by a jack 13.

Supported above the mobile frame 11 by a pair of pivotally connected struts 14 and 15 and a telescoping strut 16, is an elongated trough 18 in which is co-linearly mounted an elongated auger 20 adjacent the bottom wall 19 of the trough 20.

The auger 20 includes helical blades or flights 21 fixed concentrically about a shaft 22 having its lower end rotatably journaled in a rotary bearing 23 and its upper end portion rotatably journaled in an upper bearing 24. The upper end of the auger shaft 22 is driven by a belt and pulley transmission 25 from an electrical motor 26.

The motor 26 is driven in such a direction that the flights 21 will move or feed particles engaged by the flights 21 upward along the inclined trough 18.

The inclination of the trough 18 may be determined by the adjustment of the telescoping strut 16, which can be adjusted manually or preferably by a motor means, not shown.

The trough 18 is also provided with opposite side walls 27 and 28 which project upward from the bottom wall portion 19 substantially above the auger flights 21 and preferably open at the top, to contain the particles to be separated and the separating liquid.

The upper end portion of the trough 18 is provided with a particle discharge opening 29 and a discharge chute 30, over which the heavier particles, such as rock and other debris, may be discharged after separation from the lighter particles, such as the coal 32.

The lower end of the trough 18 is completely closed by a solid weir 34 projecting upward to a free edge 35 at a predetermined height, which determines the water level 36 of a relatively still pool 37. The top edge 35 of the weir 34 is substantially higher than the auger 21, rising to a height above the bottom wall portion 19 of approximately two to three auger diameters. The side walls 38 of the portion of the trough defining the pool area 37 rise above the top edge 35 to contain the lighter particles 32 discharging over the top of the weir 35. The discharging lighter particles descend in a spillway 39 between the weir 34 and an end wall 40.

Located above the trough 18 between its upper and lower ends is a feed hopper 42 into which is discharged from a feed inlet chute 43 a mixture 44 of the heavier and lighter particles, such as mine-run coal including the coal and other impurities such as rock, shale and other debris. The hopper 42 may be located at any desired position for discharging a mixture of coal and heavier particles into the trough 18 for separation.

Located farther up the trough 18 is a liquid dispensing apparatus, such as a water dispensing apparatus 45. The water discharged into the trough 18 above the feed hopper 42 flows down the trough along the auger 20. Being of a specific gravity less than either the lighter or heavier particles, the water 46 would normally permit all of the particles 31 and 32 to sink, were it not for the velocity of the water flowing down the trough hitting the top portions of the flights 21 of the auger 20 to provide a rippling or agitating effect, for the entire length of the trough. However, the agitation of the water 46 ceases when it enters the pool area 37.

Preferably, the lighter particles 32 discharging through the spillway 39 are de-watered upon a curved de-watering screen member 48. The de-watered coal, or other lighter particles 32 descend along the discharge chute 49, while the slurry, or water including fines of the lightweight material, such as coal dust, passes through the de-watering screen 48 and is deposited into the reservoir or sump 50.

The slurry 51 in the tank or reservoir 50 may be recirculated from the reservoir 50 through an inlet pipe 52, pump 53 and riser 54 to the water dispenser 45. The recirculated slurry 51, when introduced into the trough 18 will be of greater density than pure water, thereby facilitating the floating of lighter particles, such as coal 32. Accordingly, less velocity of liquid will be required because of its greater density, and furthermore the density of the slurry facilitates the floating of the coal 32 over the weir 34 into the spillway 39.

The density of the slurry 51 may be controlled by the introduction of fresh water into the reservoir 50, or by the removal of slurry of greatest density from the bottom of the tank 50 through the drain pipe 55. The slurry 51 discharged from the drain pipe 55 may be treated at a secondary recovery plant, and clarified to provide water which may be recycled back to the reservoir 50 and used again in the trough 18.

The density of the slurry or liquid 46 discharged by the dispensing apparatus 45 into the trough 18 may be further controlled by a movable inlet pipe section 57 which can be raised and lowered within the slurry 51 in order to tap the liquid slurry at any desired density depending upon the level of intake within the reservoir 50.

Another improved feature of the apparatus 10 is the termination of the upper end 58 of the auger flights 21 at a distance from the upper end on edge 59 of the trough 18 at the discharge opening 29, by a spacing equal to at least two auger diameters, and preferably two to eight auger diameters. This distance of the upper end 58 of the auger flights 21 from the upper end or edge 59 of the trough 18 provides a space in which the heavier solid particles 31 may accumulate to provide a dam to prevent the liquid carrier by the flights 21 from discharging through the opening 29, and thereby eliminating the waste of the washing liquid or water 46.

As an optional feature, a barrier member 60 may be fixed adjacent the upper end of the trough 18 to facilitate the accumulation of the solid particles 31 to provide an additional barrier to the flow or water through the discharge opening 29.

A further optional feature is a substantially radial vane 61 fixed to the upper extension of the rotary shaft 22 to facilitate more uniform distribution of the solid heavier particles 31. By terminating the upper end 58 of the flights 21 at a point spaced below the upper end 59 of the trough, the water dispensing apparatus 45 may be moved farther up the trough to provide a greater washing distance along the length of the trough 18, and also to provide greater gravitational force of the water 46 by virtue of its increased height above the lower end of the trough 18. Moreover, the length of the auger 20 and the trough 18 may be reduced where the dispensing apparatus 45 is located farther up the trough 18.

It is thus seen that the washing effect of the water or liquid 46 can be varied by various controls. The angle of the trough 18 may be varied by the telescoping strut 16. The position of the water dispensing apparatus 45 may be varied along the trough 18 to determine, not only the height of the water discharge and thereby its gravitational force, but also the length of the water stream through and along the trough 18. The positioning of the water dispensing apparatus 45 has greater variability by virtue of the foreshortening of the flight 21 at the point 58.

The amount of water discharge may be determined by the speed of the pump 53. The density of the washing liquid or water 46 may further be determined by the density of the slurry 51 built up in the tank 50, or by the strata of the slurry 51 in which the intake pipe section 57 is positioned, three such positions being disclosed in FIG. 1.

The washing effect may further be determined by the rotational speed of the auger 20.

The pool 37 permits a more complete and efficient separation of the heavier particles, and particularly the smaller size particles or fines of the heavier material. In pure turbulent flow, even the fines of the heavier material are sometimes caught up in the turbulent flow and permitted to discharge out the lower end of the auger. The relatively still pool 37 gives the heavier fines ample time to settle out at the bottom and be carried up the trough by the flights 21.

On the other hand, the turbulence of the water 46 above the pool level 36 gives sufficient impetus to the lighter particles, such as the coal 32, to cause them to move each other through the pool 37 above the auger. An accumulation of the lighter particles causes them to force each other over the top edge 35 of the weir 34. Of course, when the density of the separating liquid 47 is increased by the addition of the slurry 51, the lighter coal particles will tend to float more readily and more readily discharge over the weir 34.

It has been found that it is immaterial whether a solid auger 20 or a ribbon auger is used in the trough 18, as far as the creation of turbulence in the trough 18 above the pool level 36.

Because of the mobile frame 11, the apparatus 10 may be transported from one coal washing station to another. The trough 18 may be lowered by collapsing the telescoping strut 16 and by pivotally folding the struts 14, 15, and 16 until the trough 18 is located slightly above the reservoir 15.

What is claimed is:

1. An apparatus for separating relatively light particles from relatively heavy particles by use of a liquid of lesser specific gravity than any of said particles, comprising:

(a) an elongated inclined trough having an upper end, a lower end, an elongated bottom wall portion and upward projecting side walls, (b) an elongated auger rotatably mounted in said trough along said bottom wall portion, (c) feed means for introducing a mixture of said light and heavy particles into said trough above said auger, (d) liquid dispensing means for introducing liquid into said trough between said upper end and said feed means, (e) drive means for rotating said auger within said trough in a direction to feed particles caught by the flights of said auger upward toward said upper end, (f) means for discharging liquid containing said lighter particles from the lower end of said trough, (g) separating means for separating most of the larger lighter particles from the liquid slurry containing fine lighter particles, (h) a liquid reservoir for receiving liquid and said slurry from said separating means, (i) circulating means for selectively drawing liquid from selectively different levels in said reservoir and distributing said liquid to said liquid dispensing means to provide liquid of different specific gravities in said trough.

2. The invention according to claim 1 in which said circulating means comprises a pump having a discharge line connected to said liquid dispensing means and having an input line in said reservoir and means for moving the inlet portion of said input line to different levels of liquid within said reservoir.

3. The invention according to claim 2 in which said separating means comprises a screen member in the discharge path of the lighter particles from the lower end of said trough, said screen member being disposed directly above a portion of said reservoir.

4. The invention according to claim 3 further comprising a weir closing the lower end of said trough, said weir being located above said screen member.

5. An apparatus for separating relatively light particles from relatively heavy particles by use of a liquid of lesser specific gravity than any of said particles, comprising:

(a) an elongated inclined trough having an upper end portion, a lower end, an elongated bottom wall portion and upward projecting side walls, (b) an elongated auger including flights terminating in an upper end, rotatably mounted in said trough along said bottom wall portion, (c) feed means for introducing a mixture of said light and heavy particles into said trough, (d) liquid dispensing means for introducing liquid into said trough between said upper end portion and said feed means, (e) drive means for rotating said auger within said trough in a direction to feed particles caught by the flights of said auger upward toward the upper end portion of said auger, (f) said upper end portion of said trough comprising a particle discharge opening defined at least partially by an upper edge of said trough over which said heavy particles are adapted to be discharged, and (g) the upper end of said auger flights terminating a distance, generally coaxially of said auger, from said upper edge of approximately two to eight auger diameters, sufficient to permit the accumulation of heavy particles in said trough between said upper edge and the upper end of said auger flights to provide a dam for preventing substantial amounts of liquid carried by the flights of said auger from discharging through said discharge opening.

6. The invention according to claim 5 further comprising a baffle member mounted in said trough adjacent the upper edge of said trough and projecting a predetermined height above said bottom wall portion to further limit the discharge of accumulated particles through said particle discharge opening.

7. The invention according to claim 5 in which said liquid dispensing means is mounted on said trough closer to the upper end portion of said trough than to said feed means.

8. The invention according to claim 5 in which said auger includes a rotary shaft having an auger shaft section projecting upward beyond the upper end of said auger flights, and a paddle member projecting generally radially from said shaft section above the upper end of said auger flights for rotatable movement with said shaft in order to distribute the heavier particles accumulating above the upper end of said auger flights.

* * * * *